US007926651B2

(12) United States Patent
Lindenmayer

(10) Patent No.: US 7,926,651 B2
(45) Date of Patent: Apr. 19, 2011

(54) BOTTLE BOX PACKAGE

(76) Inventor: David O. Lindenmayer, Marysville, IN (US)

( * ) Notice: Subject to any disclaimer, the term of this patent is extended or adjusted under 35 U.S.C. 154(b) by 0 days.

(21) Appl. No.: 12/380,508

(22) Filed: Feb. 27, 2009

(65) Prior Publication Data

US 2010/0176024 A1 Jul. 15, 2010

(51) Int. Cl.
*A45C 13/10* (2006.01)
*A45C 13/18* (2006.01)

(52) U.S. Cl. ..... 206/1.5; 70/63; 312/218

(58) Field of Classification Search ..... 206/532, 206/525, 1.5, 298, 775–783, 0.6; 312/216, 312/217, 107, 107.5, 218; 220/243, 250, 220/676, 210, 314, 214, 323; 217/36, 69, 217/71, 11; 229/124; 70/14, 58, 163–164
See application file for complete search history.

(56) References Cited

U.S. PATENT DOCUMENTS 778,876 A * 1/1905 Matteson ..... 217/36
1,299,296 A * 4/1919 Bye ..... 217/36
1,446,100 A * 2/1923 Morris ..... 217/7
2,700,457 A * 1/1955 Munroe ..... 206/320
2,835,381 A * 5/1958 Ackermann et al. ..... 206/3
4,243,142 A * 1/1981 Foreman ..... 206/387.11
5,797,487 A * 8/1998 Young ..... 206/308.2
6,755,053 B1 * 6/2004 Dias ..... 70/14

OTHER PUBLICATIONS

Woodford Reserve at SpirtsAndCocktails.com, picture and drink by Jamie Boudreu, printed Jan. 7, 2009, shows bottle box by David Lindenmayer.

* cited by examiner

*Primary Examiner* — Mickey Yu
*Assistant Examiner* — Chun Cheung
(74) *Attorney, Agent, or Firm* — David W. Carrithers; Carrithers Law Office, PLLC

(57) ABSTRACT

A see-though package for shipping and displaying bottles of beverage vertically upright. A rectangular box is provided for receiving and holding a bottle therein. The box is formed from a top and bottom panels connecting to side panels and back support slat members at the top and bottom of the box. A pair of spaced apart cylindrical rods extending from one side panel to the other on each side of the bottle neck adjacent the top of the body of the bottle immovably secures the bottle therein. At least one of the rods is removable and held in position by a retaining means such as a peg or lock abutting one side panel with the distal end of the rod abutting a socket formed in the opposing side panel.

12 Claims, 3 Drawing Sheets

BOTTLE BOX PACKAGE

FIELD OF THE INVENTION

This invention relates in general to a decorative see-thorough bottle box package for transporting, storage, and display of beverages.

BACKGROUND OF THE INVENTION

Conventional boxes which are used to package bottles such as wine or liquor typically include a portion is in the shape of an oblong box having an open side into which a bottle to be packaged is placed and the corresponding portion is in the form of a case into which the first portion may be designed to seal the open side of the first portion.

In conventional use, upon opening a bottle packaging box enclosing a bottle, e.g., containing a quality of wine, the bottle is removed from the box and the box is then discarded. The unpackaged bottle is then placed on a shelf for sale.

The wine or liquor is placed in a package for shipment, generally in a paper or corrugated box. The bottles are positioned vertically. Within the box, each bottle needs to be supported at its bottom end spaced from the bottom of the box in a position which secures the bottle against movement laterally. The upper end of each bottle also needs to be held so that movement is prevented. In a case, the bottle packages have to be secured against moving relative to each other and against movement relative to the box in which they are positioned.

Other bottle packages fabricated from plastic or wood are enclosed on all sides to protect the product; however, the product must be removed for display.

SUMMARY OF INVENTION

In keeping with the foregoing object there is provided in accordance with one aspect of the present invention provides a see-through bottle box defining a base panel, a lid, a first side panel and a second side panel connecting to the base panel. Each one of a first side panel and a second side panel includes a front bore hole and/or a rear bore hole at a selected aligned position along the front and rear portions of the first side panel and the second side panel. The opposing side panel including a holding means comprising a depression, partially drilled bore, slot, or socket corresponding to and in alignment with a longitudinal member or rod extending through the bore hole with the distal end being disposed in a socket within the opposing panel. Thus, the rod extends between the first side panel and the second side panel with the distal end disposed into the socket holding means. A retaining means such as a pin, lock shank, or peg can be inserted into a hole in the rod to abut the side panel having the through bore in order to secure the rod from moving.

Of course, a bore can be drilled through the opposing side panel instead of the socket and secured with a second holding means such as a peg, however, by drilling a bore through the inner panel surface and only a limited distance through the panel wall the partial panel remaining provides an adequate stop and holding means for the distal end of the rod. A retaining means such as a peg, or lock extends through a perpendicular bore hole drilled through the rod limiting lateral movement of the rod by abutment against the interior side panel for retaining a bottle in the box. Moreover, by using the socket in the side panel as a holding means together with a retaining means such as a pin inserted into the rod on the interior side of the panel having the bore hole, the package will have smooth exterior panels.

A top rear longitudinal member such as a strip of material can be disposed between the first side panel and the second side panel flush with the top of the lid and extending below the lid forming a top rear support member. A bottom rear longitudinal member can be disposed between the first side panel and the second side flush with the base and projecting upwardly above the base forming a bottom rear support member. The support members add lateral stability to the box; however, the bottle disposed therein does not touch and is spaced apart from the support members.

The present invention relates to improved packaging, containers and boxes, for objects, such as bottles or similarly shaped articles, and is particularly directed to a novel and unique container for a bottle which is adapted to function as a package for the bottle during shipping, storage and handling in addition serving as a decorative see-thorough display box for holding the bottle on the shelf. The box is designed to have an open front and back to display the brand of the bottle and contents therein. While a preferred embodiment utilizes solid side panels it is contemplated that portions of the side panels could also be cut away or formed of slats to dispose the contents of the bottle so long as the side walls provide adequate support and cushioning to securely support the bottle.

It is an object of the present invention to provide a vertical bottle box having an open front and rear panel to display the label of the bottle product.

It is another object of the present invention to provide a box having side panels connecting to a top and bottom or base panel and a bottom or base longitudinal strip of material connecting the side panels to the base with a top longitudinal strip in order to provide a clear view of the front and rear of the bottle.

It is another object of the present invention to provide a pair of longitudinal bar members or rods extending across the mid section of the bottle to secure front or rear forward motion of the bottle.

It is another object of the present invention to provide a retaining means cooperatively engaging the bar or rod wherein the rod extends through a front portion of at least one side of a first side panel to a depression, slot, hole, and/or socket extending at least part of the way through the interior surface of the opposing side panel.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the several views and wherein.

DETAILED DESCRIPTION OF PREFERRED EMBODIMENT

Figure 1:
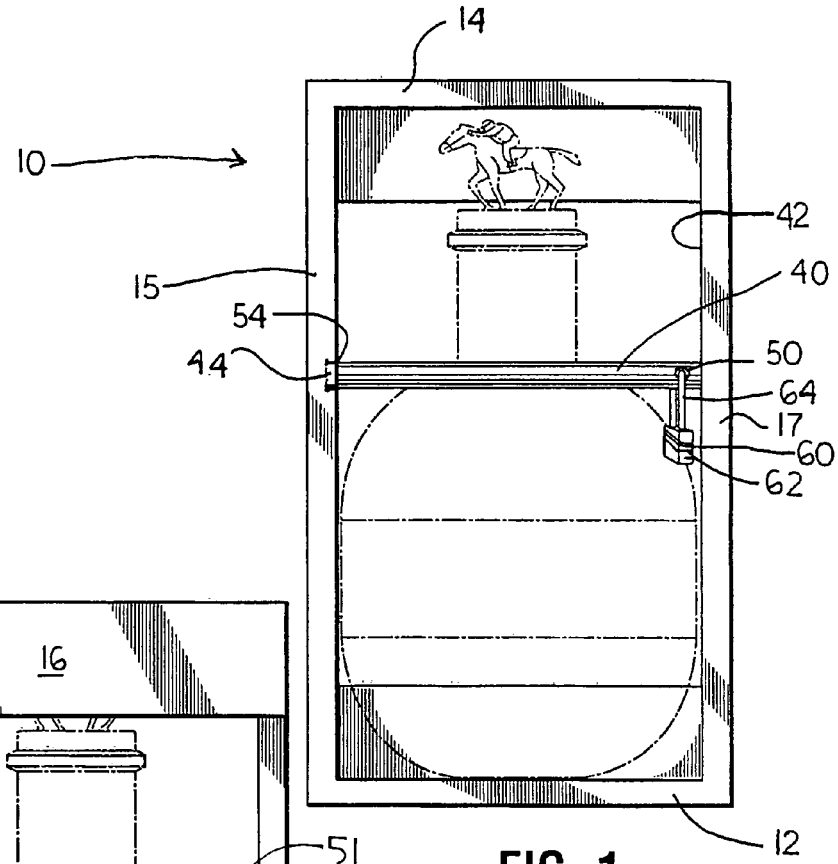
FIG. 1 is a perspective view of the bottle box package showing a dual bar and padlock gate means for immovably holding and securing a phantom bottle for shipping or display.

FIGS. 1-5 illustrate a preferred embodiment for the instant single bottle box package 10. The preferred embodiment is made of wood, of course it is contemplated that the container could be molded from a polymer or a combination of wood and plastic or even fiberglass.

As shown in one preferred embodiment individual panels are connected together by holding means such as staples, nails, glue, cord, thread, or combinations thereof. The box 10 comprises a solid bottom base panel 12 and a solid top panel or lid 14 connected together by solid rectangular side panels, wherein the left side panel is designated as a first side panel 15 and the right side panel is designated as the second side panel 17 which are stapled and/or nailed and/or glued to the exterior surface of the lid 14 and the base 12 forming a self supporting rectangular box.

In one preferred embodiment, a top rear longitudinal strip 16 of material is affixed to the rear edge surface (not shown) of the lid 14 extending between and connecting the rear edges 20, 21 respectively, of the first side panel 15 and second side panel 17 whereby it extends downwardly a selected distance pass the lid 14 to form an upper rear box support member. A second longitudinal strip 22 of material is affixed to the rear edge surface (not shown), of the base 12 and extends between and connects to the rear edges 20 of the first side panel 15 and the second side panel 17 where it projects upwardly pass the base 12 to form a base rear box support member.

A gate means including at least one removable longitudinal member such as a cylindrical rod 40 is disposed through a bore hole 31 formed in a selected side panel 15, 17 with the distal end 54 disposed in a holding means comprising a depression, slot, or socket 44. More specifically, a front bore hole and/or a rear bore hole are cut are formed with a drill at a selected position along the front of the first side panel and the second side panel and the opposing side panel.

A gate means including at least one longitudinal member such as a cylindrical rod 40 is disposed through a through bore hole 31 formed in at least one selected side panel 15, 17. The rod 40 extends through the first bore hole 31 and between the first side panel 15 and the second side panel 17. A distal end 54 of the rod 40 is disposed in a holding means comprising a depression, slot, or socket 44 formed in the interior side of the panel opposite the bore hole 31. Thus, the rod extends between the first side panel 15 and the second side panel 17 with the distal end 54 disposed into the socket 44 holding means. A retaining means such as a pin, lock shank, or peg 66 can be inserted into a perpendicular hole drilled through the rod 40 to abut either one or both of the side panels 15, 17 in order to secure the rod from moving limiting lateral movement of the rod 40 retaining a bottle in the box 10 by abutment against the interior side panel 15, 17 of the box 10. The through bore hole 31, bar 40, and socket 44 are positioned at a selected point so that the bar 40 extends inwardly to touch or spaced closely to the top of a bottle body at a point at or near the bottom portion of the neck of the bottle disposed within the box 10 to limit rearward, forward, and upward movement of the bottle within the box 10. The use of a socket 44 in the side panel as a holding means together with a retaining means such as a pin or lock shank inserted into the rod hole 50 on the interior side of the panel 15, 17 provides for a bottle box package 10 having smooth exterior panels as opposed to a package which utilizes a peg or retaining means disposed through a rod 40 extending through the exterior panel 15, 17. Support rod 51 is captured in bore holes 45 and 46 and provides support for the rear of the bottle. A further embodiment includes two pad locks 62, one on each end of rod 40.

One preferred embodiment as shown in the FIGS. 1-5 includes bore holes 31, rods 40 and 51, and sockets 44, 45 and 46 wherein the rods 40 are positioned, aligned, and spaced apart in a corresponding relationship to the shape of the bottle so that the bottle can be secured and viewed from the front or rear of the bottle box package 10.

Of course a second embodiment could utilize a bore 31 can be drilled through both panels 15, 17, instead of the socket 44 and secured with and additional second holding means such as pair of a pegs to prevent lateral movement of the rod 40 therein; however, by drilling a bore through the inner panel surface and only a limited distance through the panel wall providing a socket 44, the partial panel remaining provides an adequate stop and holding means for the distal end of the rod 40 resulting in a more efficient manner and less costly method of fabrication.

Figure 2:
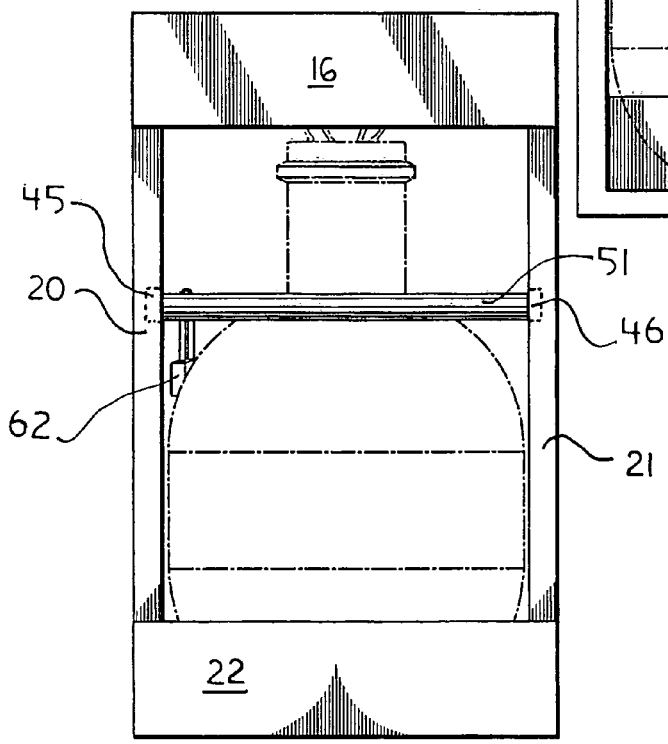
FIG. 2 is a rear view of the bottle box package of FIG. 1 showing a top and bottom lateral box support member.
Figure 3:
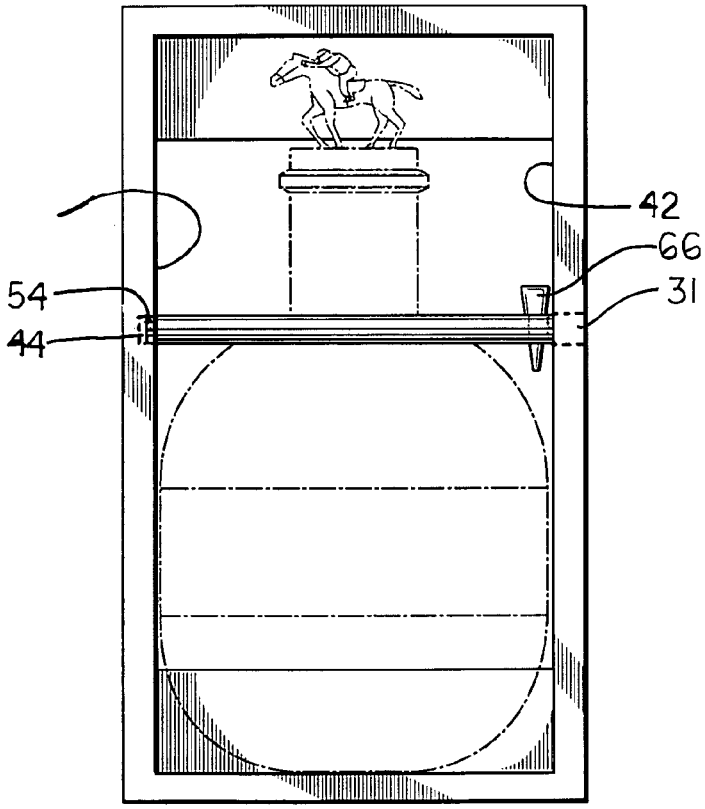
FIG. 3 is a perspective view of the bottle box package showing a peg and duel bar gate means for immovably holding and securing a phantom bottle for shipping or display.
Figure 5:
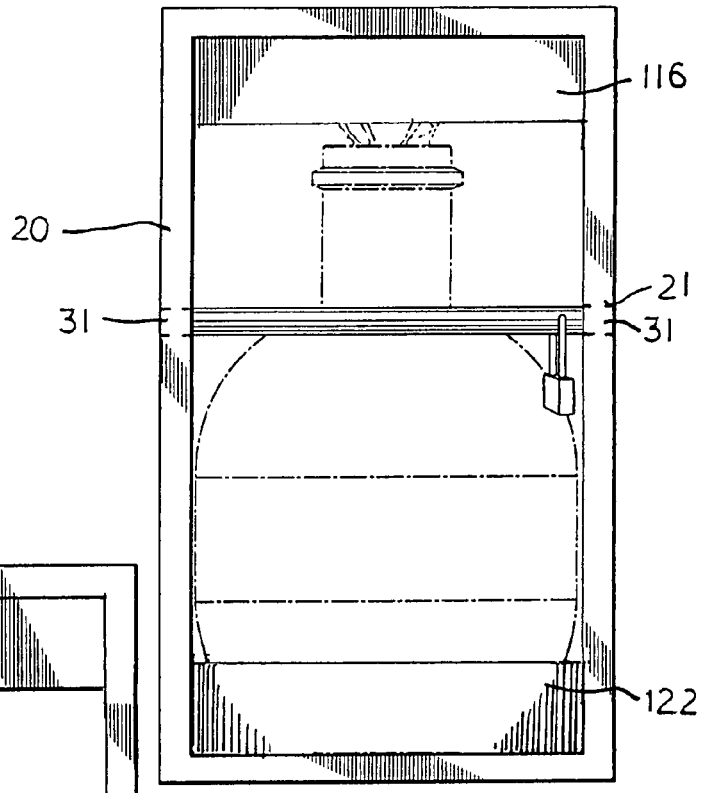
FIG. 5 is a rear view of the bottle box package of FIG. 1 without the top and bottom lateral box support member.
Figure 4:
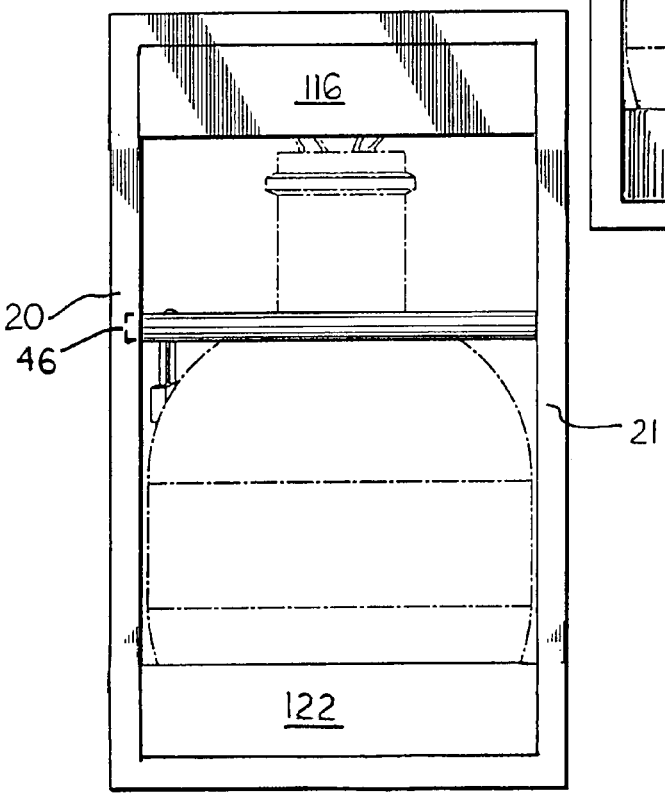
FIG. 4 is a rear view of the bottle box package of FIG. 1 showing a top and bottom lateral box support member disposed between the side panels flush therewith.

More particularly, the bottle illustrated in phantom lines in FIGS. 1-3, is retained within the box 10 by a gate means comprising a pair of bore holes 31 and 45 formed by drilling in at a selected position such as the front middle portion of a selected side panels 17. For example, the second side panel 17 includes a pair of rods 40 and 51 inserted through bores 31 and 46 extending through side panel 17 across the front of the box 10 where they are inserted into a pair of opposing depressions or sockets 44 and 45 which extend only a selected distance into the opposing side panel 15 and rests therein. The rod 40 included a retaining means comprising a hole 50 drilled normal thereto at a selected distance from the interior surface of the second panel 17, and a retaining means such as a shank 64 of a padlock, pin, or peg inserted into the hole 50 in the rod 40 abutting the interior surface 42 of the side wall 17 to restrict the rod 40 from moving backward and securing the distal end 54 of the rod 40 resting in the socket 44 preventing lateral movement thereof.

In at least one preferred embodiment, a resilient cushioning means 60 such as a pad, rubber band, O-ring, or other soft cushioning material circumvents the padlock 62 preventing damage to the bottle therein and providing a fanciful retaining means.

Optionally, the top rear support box member and/or the base rear support box member can be eliminated because they do not touch or aid in holding the bottle. A rear panel could optionally be added to the box but is unnecessary. Finally, a top rear support box member 116 and/or a base rear support box member 122 can be inserted and affixedly mounted in between and flush with the rear edges 20, 21 of the side panels 15, 17 instead of being affixed to the rear edges 20, 21 of the side panels 15, 17.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented herein above. Rather, what is intended to be covered is within the spirit and scope of the appended claims.

I claim:

1. A bottle box, comprising:

a base;

a lid;

a first side panel and a second opposing side panel connecting to said base and said lid;

a top rear longitudinal member extending between said first side panel and said second side panel and extending below said lid;

a bottom rear longitudinal member extending between said first side panel and said second side panel and extending above said base;

a third longitudinal member affixed to said first side panel and said second side panel at a selected position for holding a bottle;

said first side panel having formed therein a socket means and said second side panel having formed therein a through bore hole at selected position and in alignment with said socket means;

a gate means for abutting a front neck portion of said bottle, said gate means comprising a fourth longitudinal member extending through said through bore hole, extending between said first side panel and said second side panel and into said socket means, said fourth longitudinal member having formed therein a transverse bore hole; and retaining means extending through said transverse bore hole in said fourth longitudinal member for abutting an interior surface of said first side panel or said second side panel for limiting lateral movement of said fourth longitudinal member within said box.

2. The bottle box of claim 1 wherein said third longitudinal member abuts a rear lower neck portion of said bottle, thus limiting rearward and upward movement of said bottle.

3. The bottle box of claim 1 wherein said retaining means comprises a padlock passing through said transverse bore hole in said fourth longitudinal member.

4. The bottle box of claim 1 wherein said retaining means comprises a peg tightly and removably pressed into said transverse bore hole in said fourth longitudinal member shaped.

5. The bottle box of claim 1 wherein said third longitudinal member is a cylindrical rod.

6. The bottle box of claim 1 wherein said fourth longitudinal means is a cylindrical rod.

7. A bottle box, comprising:

a base;

a lid;

a first side panel and a second opposing side panel connecting to said base and said lid;

a top rear longitudinal member extending between said first side panel and said second side panel and extending below said lid;

a bottom rear longitudinal member extending between said first side panel and said second side panel and extending above said base;

a third longitudinal member affixed to said first side panel and said second side panel in a selected position for limiting upward and rearward movement of said bottle;

said first side panel having formed therein a first through bore hole and said second side panel having formed therein a second through bore hole at selected position and in alignment with said first through bore hole;

a gate means for abutting a front neck portion of said bottle, said gate means comprising a fourth longitudinal member extending through said first through bore hole, extending between said first side panel and said second side panel and through said second through bore hole, said fourth longitudinal member having formed therein two transverse bore holes;

a first retaining means extending through said first transverse bore hole in said fourth longitudinal member for abutting an interior surface of said first side panel for limiting lateral movement of said fourth longitudinal member within said box; and a second retaining means extending into said second transverse bore hole in said fourth longitudinal member for abutting an interior surface of said second side panel for limiting lateral movement of said fourth longitudinal member within said box.

8. The bottle box of claim 7 wherein said third longitudinal member abuts a rear lower neck portion of said bottle, thus limiting rearward and upward movement of said bottle.

9. The bottle box of claim 7 wherein said retaining means comprise two padlocks passing through said transverse bores hole in said fourth longitudinal member.

10. The bottle box of claim 7 wherein said retaining means comprise two pegs tightly and removably pressed into said transverse bore holes in said fourth longitudinal member shaped.

11. The bottle box of claim 7 wherein said third longitudinal member is a cylindrical rod.

12. The bottle box of claim 7 wherein said fourth longitudinal means is a cylindrical rod.

* * * * *